US005266012A

United States Patent [19]

Hashimoto et al.

[11] Patent Number: 5,266,012

[45] Date of Patent: Nov. 30, 1993

[54] VIBRATING COLUMN PUMP

[75] Inventors: Hiroyuki Hashimoto, Sendai; Hirokuni Hiyama; Toshiro Maekawa, both of Tokyo; Kazuyoshi Yamamoto, Ayase, all of Japan

[73] Assignee: Ebara Corporation, Tokyo, Japan

[21] Appl. No.: 953,851

[22] Filed: Sep. 30, 1992

[30] Foreign Application Priority Data

Sep. 30, 1991 [JP] Japan ..... 3-251598

[51] Int. Cl.[5] ..... F04B 43/00

[52] U.S. Cl. ..... 417/412; 417/472

[58] Field of Search ..... 417/412 O, 472, 473, 417/474, 475, 478, 480; 92/37

[56] References Cited

U.S. PATENT DOCUMENTS

| | | | |
|---|---|---|---|
| 4,718,716 | 11/1988 | Richelsoph | 417/412 |
| 5,129,789 | 7/1992 | Thornton et al. . | |
| 5,147,281 | 9/1992 | Thornton et al. . | |

FOREIGN PATENT DOCUMENTS

| | | | |
|---|---|---|---|
| 705162 | 3/1965 | Canada | 417/412 |
| 2123867 | 11/1972 | Fed. Rep. of Germany . | |
| 850942 | 9/1939 | France . | |
| 1360768 | 4/1964 | France . | |
| 1592548 | 6/1970 | France . | |
| 106863 | of 1917 | United Kingdom . | |
| 759345 | 10/1956 | United Kingdom . | |

OTHER PUBLICATIONS

China Japan Vibration Joint Conference 1984, pp. 351-358, H. Hiyama, et al., "Pumping Characteristics of Liquid in a Vibrating Pipe".

JSME International Journal, Series II, vol. 34, No. 3, 1991, pp. 333-339, H. Hiyama, et al, "The Effect of Pumping in a Vertically Vibrating Pipe".

ASAIO Transactions, vol.37, No. 3, M240-M241, Jul-.-Sep. 1991, S. Nitta, et al., "The Newly Designed Univalved Artificial Heart".

Artificial Heart 3, 1991, pp. 87-91, S. Nitta, et al., "An Electromagnetically Driven Univalved Artificial Heart".

Journal of Japan Society Medical Electronics and Bioengineering, vol. 27, May 1989, pp. 406, Nitta, et al, "A Vibrating Electro Magnetic Pump For Ventricular Assistance 38 .

Journal of Japan Artificial Organs, vol. 19, No. 1, 1990, pp. 113-116, Sonobe, et al., "The Development and Evaluation of Vibrating Electromagnetic Pump for the Artificial Heart".

China Japan Vibration Joint Conference 1984, pp. 351-358, H. Hiyama, et al., "Pumping Characteristics of Liquid in a Vibrating Pipe".

JSME International Journal, Series II, vol. 34, No. 3, 1991, pp. 333-339, H. Hiyama, et al, "The Effect of Pumping in a Vertically Vibrating Pipe".

ASAIO Transactions, vol. 37, No. 3, M240-M241, Jul-.-Sep. 1991, S. Nitta et al., "The Newly Designed Univalved Artificial Heart".

Artificial Heart 3, 1991, pp. 87-91, S. NITTA, et al., "An Electromagnetically Driven Univalved Artificial Heart".

*Primary Examiner*—Richard A. Bertsch
*Assistant Examiner*—Alfred Basichas
*Attorney, Agent, or Firm*—Oblon, Spivak, McClelland, Maier & Neustadt

[57] ABSTRACT

A vibrating column pump pumps liquid by making use of liquid vibration generated at the time when the vibrating pipe is vibrated in a longitudinal direction thereof. The vibrating column pump comprises a vibrating pipe for pumping liquid therethrough, flexible pipes for connecting both ends of the vibrating pipe with a stationary suction pipe and a stationary outlet pipe, vibrating means for vibrating the vibrating pipe in a longitudinal direction thereof, and retainer means for removably retaining the vibrating pipe in such a manner that the vibrating pipe is removably connected to the vibrating means. The liquid contacting unit including the vibrating pipe and the flexible pipes is separated from the vibrating means so that the liquid contacting unit is disposable and can be easily replaced with a new one.

5 Claims, 4 Drawing Sheets

VIBRATING COLUMN PUMP

BACKGROUND OF THE INVENTION

1. Field of the Invention

The present invention relates to a vibrating column pump, and more particularly to a vibrating column pump which pumps liquid by making use of liquid vibration, in a vibrating pipe, generated at the time when the vibrating pipe with a control valve is vibrated in a longitudinal direction thereof.

2. Description of the Prior Art

Conventionally, there has been proposed a vibrating column pump which obtains a pumping action by vibrating a cylindrical straight pipe in a longitudinal direction thereof. This type of the vibrating column pump is disclosed in, for example, Laid-Open patent publication No. 58-144700, Laid-Open patent publication No. 61-275600 and Laid-Open utility model publication No. 61-110900. In this type of vibrating column pump, a lower portion of the vibrating pipe is submerged in the liquid in a tank, and the vibrating pipe is vertically vibrated by a vibrator provided on the outer periphery of the vibrating pipe to thus pump liquid. Therefore, in the case where liquid is pumped by the application of the vibrating column pump, it is necessary to carry out a preliminary arrangement that the vibrating pipe is operably installed in the tank in such a manner that the lower portion of the vibrating pipe is submerged in the liquid.

Since such preliminary arrangement is troublesome, an integral type of vibrating column pump has been proposed in Laid-Open patent publication No. 1-219400. This vibrating column pump comprises a cylindrical weak magnetic material provided on the outer periphery of the vibrating pipe, a plurality of permanent magnets having respective different polarities disposed in a longitudinal direction of the vibrating pipe and magnetized in a radial direction, and a plurality of magnet coils provided outside the permanent magnets and disposed in a longitudinal direction of the vibrating pipe. The vibrating pipe and the permanent magnets jointly constitute a movable unit, the magnet coils constitutes a stationary unit, and the movable unit is reciprocatingly moved in a longitudinal direction of the vibrating pipe by supplying an alternating current to the magnet coils. Further, the movable unit and the stationary unit are housed in a casing, thereby constructing an integral type of pump which can be immediately used only by connecting a suction pipe and an outlet pipe to the casing.

However, in the vibrating column pump disclosed in Laid-Open patent publication No. 1-219400, the liquid contacts both of the movable unit and the stationary unit while pumping the liquid. Therefore, the entire components of the pump must be replaced with new ones when a liquid contacting portion is replaced after use. Accordingly, in case of a living body related liquid such as blood, since the liquid contacting portion must be pasteurized after use, this type of the vibrating column pump cannot be used.

Since sealing is not effected between the movable unit and the stationary unit, the pumped liquid enters into the clearance between the movable unit and the stationary unit. For example, in case of a living body related liquid such as blood or a biotechnology related liquid such as culture solution, the liquid enters into the clearance between the movable unit and the stationary unit, thus cells in the liquid are easily subject to damage. The conventional vibrating column pump is also problematic in that various germs propagate themselves in the clearance between the movable unit and the stationary unit while the pump is not in operation.

Since sealing is not effected between the movable unit and the stationary unit, air passes through the clearance between the movable unit and the stationary unit and flows backward from a valve chamber into the vibrating pipe in the self-priming process, thus self-priming effect cannot be achieved. Further, there exist structural elements such as a spring in the flow passage thus the pumped liquid is contaminated by foreign matter caused by corrosion of the structural elements.

SUMMARY OF THE INVENTION

It is an object of the present invention to provide a vibrating column pump in which a liquid contacting unit including a vibrating pipe is separated from vibrating means so that the liquid contacting unit is disposable and can be easily replaced with a new one, and can be perfectly sealed out from the external surroundings.

According to the present invention, there is provided a vibrating column pump comprising: a vibrating pipe for pumping liquid therethrough when the vibrating pipe is vibrated in a longitudinal direction thereof; a control valve provide on the vibrating pipe for allowing the liquid to pass through when the control valve is open by liquid pressure in the vibrating pipe; flexible pipes for connecting both ends of the vibrating pipe with a stationary suction pipe and a stationary outlet pipe which are fixedly provided; vibrating means provided adjacent to the vibrating pipe for vibrating the vibrating pipe in a longitudinal direction thereof; and retainer means for removably retaining the vibrating pipe in such a manner that the vibrating pipe is removably connected to the vibrating means.

With the above structure, the vibrating pipe with the control valve has both axial ends connected to the stationary suction pipe and the stationary outlet pipe through the respective flexible pipes, the vibrating pipe is connected to vibrating means provided adjacent to the vibrating pipe by retaining means. The vibrating pipe is vibrated by the vibrating mean in a longitudinal direction thereof, the liquid is pumped in the vibrating pipe through the stationary suction pipe and then passes through the control valve in the vibrating pipe, and is discharged from the stationary outlet pipe.

When the vibrating column pump is used to pump blood and the liquid contacting unit is required to be replaced with a new one from sanitary point of view, the vibrating pipe is removed from the retaining means and disconnected from the vibrating means while the vibrating pipe remains being connected to the stationary suction pipe and the stationary outlet pipe through the respective flexible pipes. In the case where the stationary suction pipe and the stationary outlet pipe are used together with vinyl tubes connected thereto, they are integrally replaced with new ones while remaining as they are. After replacing, a new vibrating pipe is connected to the vibrating means through the retaining means and restored in its original condition.

The above and other objects, features and advantages of the present invention will become more apparent from the following description when taken in conjunction with the accompanying drawings in which a preferred embodiment of the present invention is shown by way of an illustrative example.

DETAILED DESCRIPTION OF THE PREFERRED EMBODIMENT

A vibrating column pump of the present invention will be described below with reference to FIGS. 1 through 4.

Figure 1:
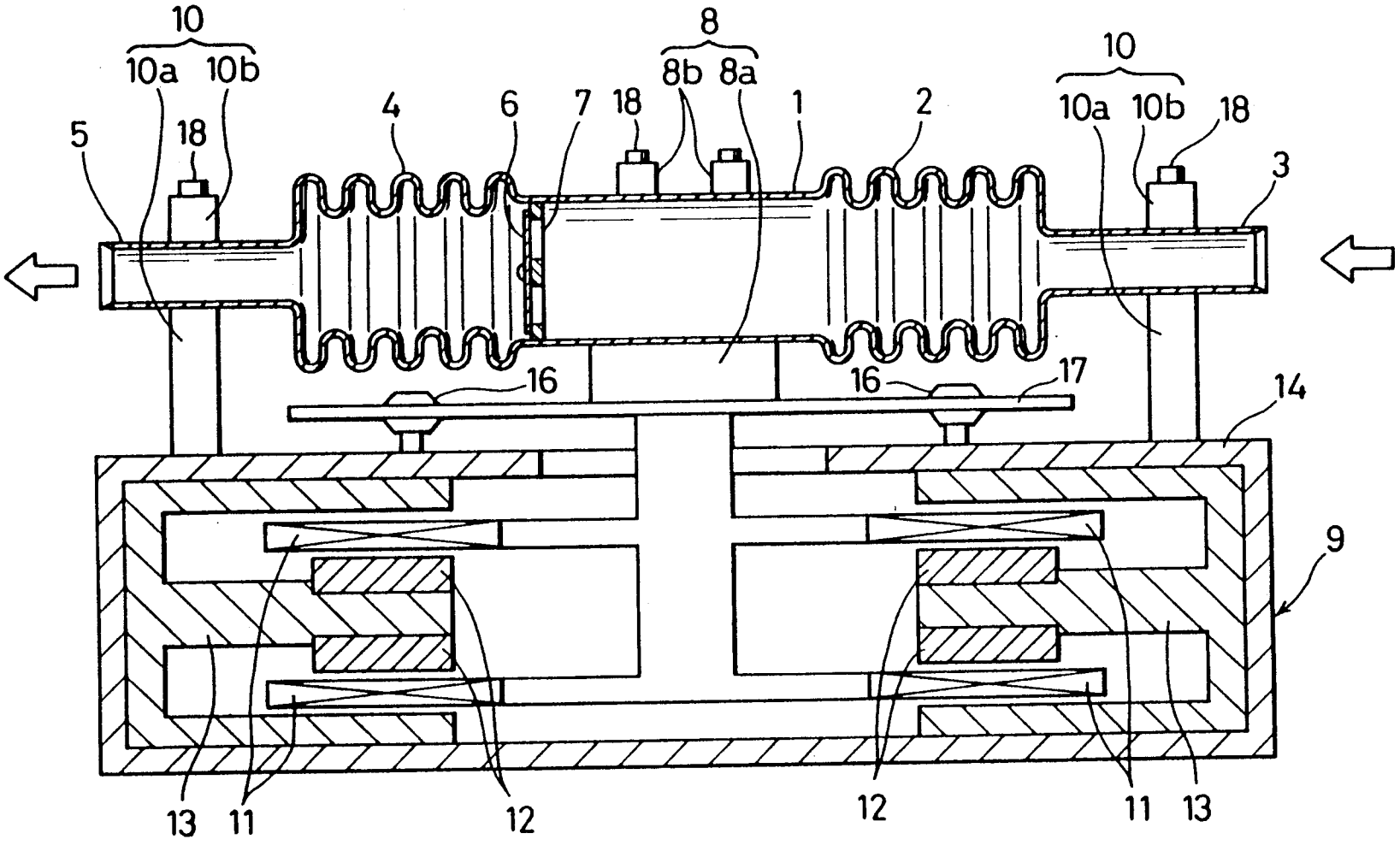
FIG. 1 is a cross-sectional view of a vibrating column pump according to the present invention.
Figure 2:
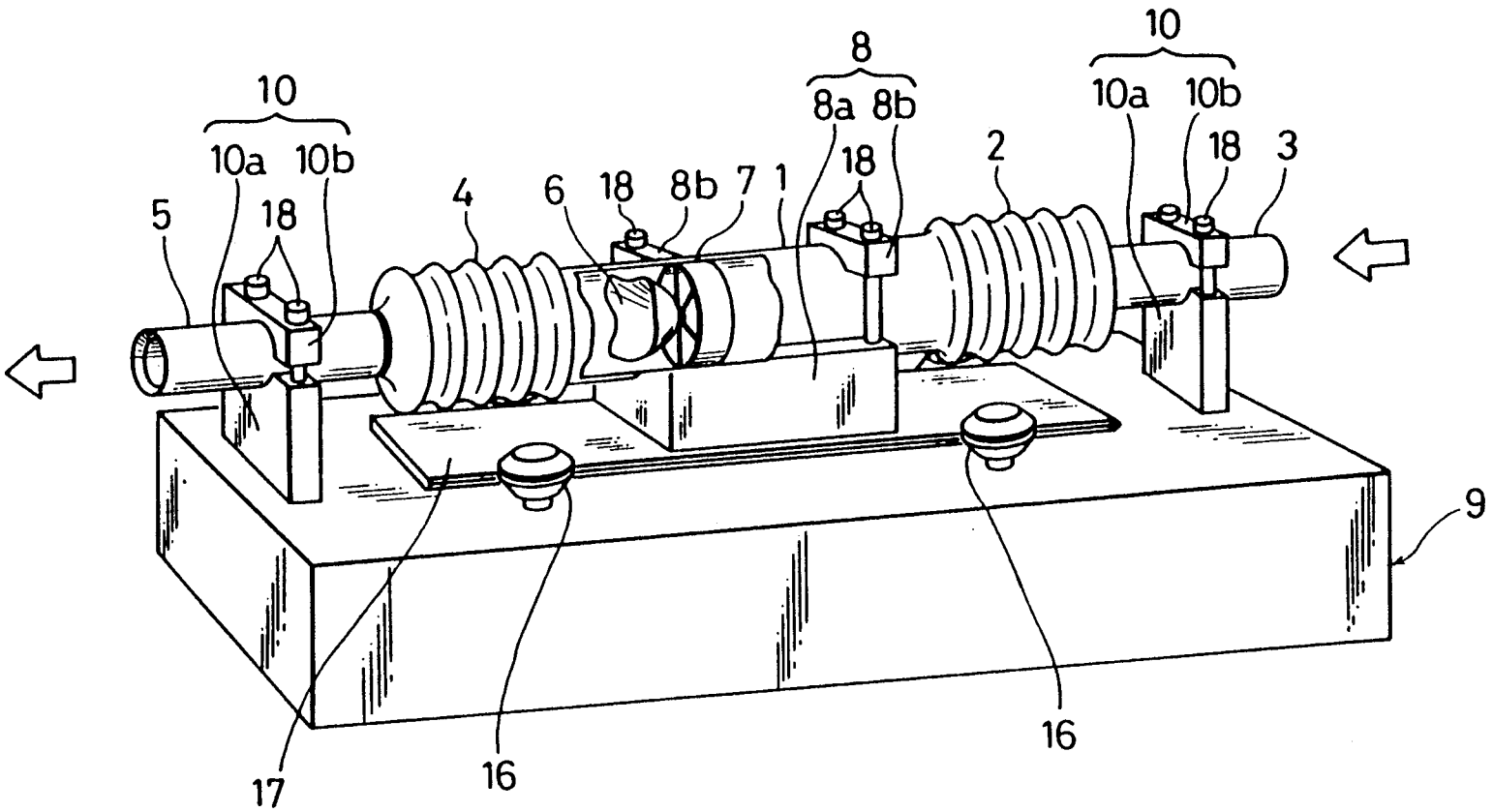
FIG. 2 is a perspective view of the vibrating column pump according to the present invention.

As shown in FIGS. 1 and 2, a cylindrical vibrating pipe 1 has a suction side end connected to a stationary suction pipe 3 through a bellows 2 and an outlet side end connected to a stationary outlet pipe 5 through a bellows 4. The bellows 1 and 4 constitute a flexible pipe capable of expansion and contraction. The vibrating pipe 1, the bellows 2 and 4, the stationary suction pipe 3 and the stationary outlet pipe 5 jointly constitute a liquid contacting unit which contacts the liquid when the pump is in operation. The stationary pipes 3 and 5 of the liquid contacting unit have their respective ends connected to vinyl tubes (not shown), thereby forming a disposable and integral piping arrangement.

Figure 3:
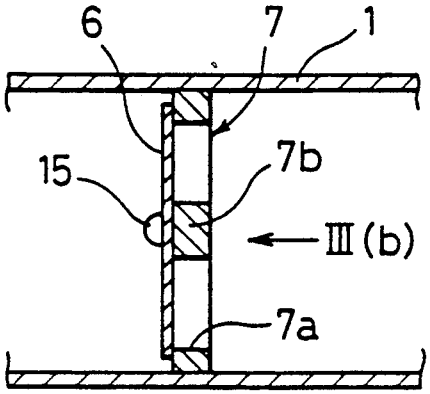
FIGS. 3(*a*) through 3(*c*) show a control valve in the vibrating column pump according to the present invention, FIG. 3(*a*) is a cross-sectional view of the control valve, FIG. 3(*b*) is a view as viewed from an arrow III(*b*) of FIG. 3(*a*), and FIG. (*c*) is a view showing the manner in which the control valve operates.
Figure 3:
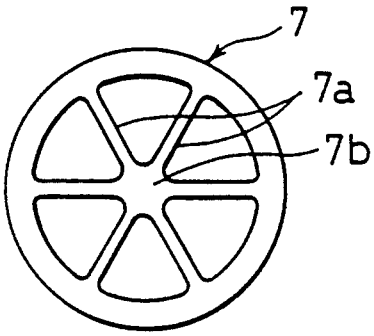
Figure 3:
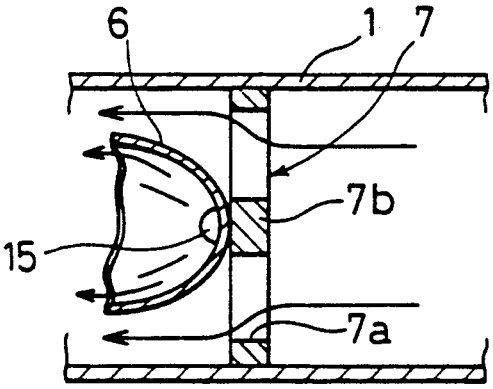

The vibrating pipe 1 has therein a control valve called a jellyfish valve comprising a flexible membrane 6 capable of opening in one way by liquid pressure and a valve seat 7 for supporting the flexible membrane 6 (see FIG. 3(*a*)). As shown in FIG. 3(*b*), the valve seat 7 is in the form of a circular disk and has an outer periphery fixed to the inner periphery of the vibrating pipe 1. The valve seat 7 is formed with a plurality of sector-shaped holes 7*a* for allowing liquid to pass through, and a central portion 7*b* for attaching the flexible membrane 6 at the central portion of the circular disk. The flexible membrane 6 is placed on the valve seat 7 and fixed to the central portion 7*b* of the valve seat 7 by a fixture 15 such as a screw.

When the vibrating pipe 1 is vibrated to pump liquid such as blood, the liquid passes through the holes 7*a* of the valve seat 7 as shown in FIG. 3(*c*). The flexible membrane 6 made of an elastic membrane assumes the form of a corolla of a flower by a forward fluid flow, thereby allowing the liquid to flow downward. When the liquid such as blood flows backward, the flexible membrane 6 spreads over the valve seat 7 so as to adhere closely to the valve seat 7. Therefore, the flexible membrane 6 closes the holes 7*a* and checks counterflow of the liquid. The vibrating pipe 1, the bellows 2 and 4, the stationary suction pipe 3, the stationary outlet pipe 5, the flexible membrane 6 and the valve seat 7 are made of synthetic resin material.

As shown in FIG. 1, the vibrating pipe 1 is removably connected to a vibrating means installed in an external driving device 9 by a vibrating pipe retainer 8. As shown in FIG. 2, the vibrating pipe retainer 8 comprises a support member 8*a* and two clamping members 8*b*, the vibrating pipe 1 is removably held between the support member 8*a* and the clamping members 8*b* using fastening bolts 18.

The vibrating means comprises magnet coils 11 and permanent magnets 12 which are provided in confrontation with each other in a radial direction and juxtaposed in a longitudinal direction of the vibrating pipe 1 so that vibration of the vibrating pipe 1 in the longitudinal direction can be controlled. The magnet coils 11 are supported by the support member 8*a* of the vibrating pipe retainer 8. The vibrating pipe 1 and the magnet coils 11 are coupled through the vibrating pipe retainer 8. On the other hand, the permanent magnets 12 provided radially inwardly of the magnet coils 11 are fixed to a supporting member 13. The supporting member 13 is fixed to a casing 14 of the external driving device 9. The permanent magnet 12 is adapted to generate magnetic force (or magnetic flux) directed radially outwardly. Two pairs of guide rollers 16 are fixed to the casing 14 so that the guide rollers 16 hold and guide a guide rail 17 fixed on the vibrating pipe retainer 8.

In operation, alternating current is supplied to the magnet coils 11, the reciprocating thrust is generated on the magnet coils 11 by the action of the alternating current and the radial magnetic field in a radial direction caused by the permanent magnets 11. As a result, the vibrating pipe 1 is reciprocatingly moved in a longitudinal direction. At this time, the amplitude of vibration is controlled by the control of the current flowing through the magnet coils 11.

The stationary suction pipe 3 and the stationary outlet pipe 5 are fixed to the casing 14 of the external device 9 by stationary pipe retainers 10. As shown in FIG. 2, each stationary pipe retainer 10 comprises a support member 10*a* and a clamping member 10*b*, the stationary suction pipe 3 and the stationary outlet pipe 5 are removably held between the support member 10*a* and the clamping member 10*b* using fastening bolts 18.

Next, operation of the vibrating column pump thus constructed will be described below.

Before operation the stationary suction pipe 3 and the stationary outlet pipe 5 ar connected to the vibrating pipe 1 through the bellows 2 and 4, the stationary suction pipe 3 and the stationary outlet pipe 5 are supported by the external driving device 9 through the stationary pipe retainers 10, and then the vibrating pipe 1 is connected to the vibrating means in the external driving device 9 through the vibrating pipe retainer 8. Thereafter, the vibrating pipe 1 is vibrated by the vibrating means, and the liquid is pumped in the vibrating pipe 1 through the stationary suction pipe 3 and then discharged to the stationary outlet pipe 5 through the control valve which is open or closed by the liquid pressure.

The pumping action by the vibrating pipe is as follows:

(1) In the case where the control valve moves so as to follow motion of the vibrating pipe (in the case where there is a corresponding movement between the valve and the pipe)

(a) Self-priming process

In this case, at the time of starting the pump, the piping system is not filled with liquid, and there is a free surface in the stationary suction pipe 3.

In the case where there is a corresponding movement between the valve and the vibrating pipe, when the vibrating pipe 1 is reciprocatingly moved, the liquid level in the vibrating pipe 1 is also reciprocatingly moved in accordance with fluctuation of gas pressure in the vibrating pipe 1. This reciprocating motion of the liquid level corresponds to vibration in the spring-mass system comprising a spring of gas column and a mass of liquid column. Since attenuation caused by friction or the like is small, the frequency of reciprocating motion of the vibrating pipe 1 is adjusted so as to be equal to the natural frequency of gas column-liquid column system in the pipe, whereby the pressure of the gas column in the pipe becomes very high. Thus, the valve is open when the pressure of the gas column in the pipe becomes equal to or higher than a set pressure of the valve, and the upper limit of pressure of gas column is maintained as high as the set pressure of the valve. Therefore, the average pressure of gas column per a cycle of vibration is lower than atmospheric pressure, the liquid column is moved by an amount corresponding to the pressure difference between the average pressure of gas column and atmospheric pressure. This action occurs continuously, eventually the liquid level reaches the outlet end of the vibrating pipe 1.

(b) The discharge process of liquid

After the liquid level reaches the outlet end of the vibrating pipe 1, the liquid column pushes the valve by the inertia of movement of the liquid column in the pipe, thus the liquid is discharged from the outlet end of the vibrating pipe 1.

(2) In the case where the valve does not follow the motion of the vibrating pipe 1

Figure 4:
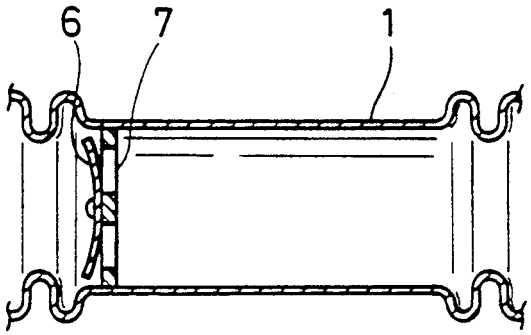
FIGS. 4(*a*) and 4(*b*) are views showing the manner in which the vibration column pump according to the present invention operates.
Figure 4:
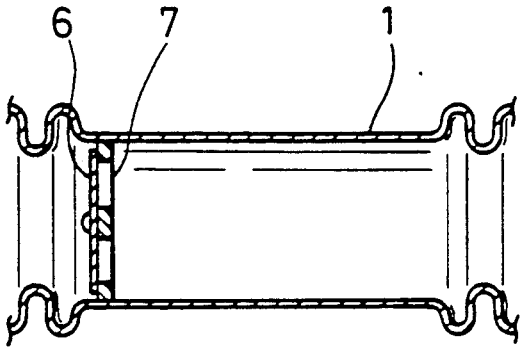

(a) In FIG. 4(*a*), the vibrating pipe 1 is moved rightward, the flexible membrane 6 cannot follow the vibrating pipe 1 and is moved rightward in a slight lag state from the vibrating pipe 1. Thus, there occurs a slight clearance between the valve seat 7 and the flexible membrane 6.

(b) When the vibrating pipe 1 reaches the right-hand end thereof, the flexible membrane 6 can catch up with the valve seat 7, thus closing the valve seat 7.

(c) When the vibrating pipe 1 is moved leftward while the flexible membrane 6 remains closing the valve seat 7, the liquid is moved leftward together with the vibrating pipe 1. When the vibrating pipe 1 is moved rightward, the movement of the liquid in the vibrating pipe 1 is small because of the inertia of the movement of the liquid. The above processes (a) to (c) are repeated, eventually the liquid reaches the outlet end of the vibrating pipe 1. When the vibrating pipe 1 is moved rightward, the liquid enters into the bellows 4 and then flows toward the stationary outlet pipe 5 from the bellows 4, and is finally discharged from the stationary outlet pipe 5.

In the case where the vibrating column pump thus constructed has been used for pumping blood, it is required to replace the liquid contacting unit with a new one from a sanitary point of view. In this case, the vibrating pipe 1, the bellows 2 and 4, the stationary suction pipe 3, the stationary outlet pipe 5 and vinyl tubes connected to the respective stationary pipes 3 and 5 are integrally removed from the vibrating pipe retainer 8 and the stationary pipe retainers 10. Thereafter, a new vibrating pipe 1, new stationary pipes 3 and 5 connected to the vibrating pipe 1 through new bellows 2 and 4 are attached to the external driving device 9 by the vibrating pipe retainer 8 and the stationary pipe retainers 10 and restored in their original condition.

In the above embodiment, the lateral type of the vibrating column pump is shown and described, however, needless to say, the vertical type of the vibrating column pump can be used. Further the magnet coils and the permanent magnets are used as vibrating means, other types of vibrating means can be used.

Although the bellows are used as a flexible pipe in the embodiment, any other type of flexible pipe can be used as far as it can absorb vibration of the vibrating pipe. Further, in the embodiment, a jellyfish valve is employed as a control valve, however, an other type of valve can be used.

As is apparent from the above description, according to the present invention, the liquid contacting unit including the vibrating pipe and the flexible pipes is separated from the vibrating means and removable from the vibrating means. Therefore, the liquid contacting unit can be easily pasteurized and washed, components of the liquid contacting unit are disposable, and the vibrating column pump is suitably applicable to the pump for pumping such liquid where pasteurization or wash of the liquid contacting unit is required.

Inasmuch as the liquid contacting unit is completely sealed out from the external surroundings, when transporting a living body related liquid or a biotechnology related liquid, cells in the liquid are not subject to damage, and various germs does not propagate themselves while the pump is not in operation.

Since, the liquid contacting unit is completely sealed out from the external surroundings, air does not flow backward and does not enter into the vibrating pipe at the self-priming process. Since there exists only a control valve made of plastic resin material in the liquid contacting unit, the liquid is not contaminated by foreign matter caused by corrosion of the structural elements.

Although certain preferred embodiments of the present invention have been shown and described in detail, it should be understood that various changes and modification may be made therein without departing from the scope of the appended claims.

What is claimed is:

1. A vibrating column pump comprising:

a vibrating pipe for pumping liquid therethrough when said vibrating pipe is vibrated in a longitudinal direction thereof;

a control valve provided on said vibrating pipe for allowing the liquid to pass through when said control valve is opened by liquid pressure in said vibrating pipe;

flexible pipes for connecting both ends of said vibrating pipe with a stationary suction pipe and a stationary outlet pipe which are fixedly provided;

vibrating means provided adjacent to said vibrating pipe for vibrating said vibrating pipe in a longitudinal direction thereof; and retainer means vibrated by said vibrating means, for removably retaining said vibrating pipe in such a manner that said vibrating pipe is removably connected to said vibrating means, wherein said retaining means comprises a support member for supporting said vibrating pipe and transferring vibration from said vibrating means to said vibrating pipe, and a clamp member for clamping said vibrating pipe in cooperation with said support member, and wherein said vibrating pipe, said control valve, said flexible pipes, said stationary suction pipe and said stationary outlet pipe jointly constitute a liquid contacting unit which is offset from said vibrating means and wherein said vibrating means does not enclose said liquid contacting unit so that said liquid contacting unit is disposable.

2. The vibrating column pump according to claim 1, further comprising guide means provided adjacent to said vibrating pipe for guiding reciprocating motion of said vibrating pipe.

3. The vibrating column pump according to claim 1, wherein said control valve comprises a valve seat having holes, and a flexible membrane provided on said valve seat, said flexible membrane being capable of changing its shape by liquid pressure.

4. The vibrating column pump according to claim 1, wherein said flexible pipe comprises a bellows.

5. The vibrating column pump according to claim 1, wherein said vibrating means comprises permanent magnets and magnet coils which are provided in confrontation with each other in a radial direction.

* * * * *